United States Patent [19]

Arikawa

[11] Patent Number: 4,870,386

[45] Date of Patent: Sep. 26, 1989

[54] FUSE FOR USE IN HIGH-VOLTAGE CIRCUIT

[75] Inventor: Hiroo Arikawa, Tokyo, Japan

[73] Assignee: SOC Corporation, Japan

[21] Appl. No.: 216,419

[22] Filed: Jul. 7, 1988

[30] Foreign Application Priority Data

Jul. 16, 1987 [JP] Japan ..... 62-175936

[51] Int. Cl.[4] ..... H01H 85/04; H01H 85/12

[52] U.S. Cl. ..... 337/162; 337/293

[58] Field of Search ..... 337/161, 162, 163, 164, 337/293

[56] References Cited

U.S. PATENT DOCUMENTS 3,267,238 8/1966 Arikawa et al. ..... 337/164

FOREIGN PATENT DOCUMENTS 1233477 2/1967 Fed. Rep. of Germany ..... 337/293
2645809 4/1978 Fed. Rep. of Germany ..... 337/293
473335 10/1937 United Kingdom .
857281 12/1960 United Kingdom .

*Primary Examiner*—H. Broome
*Attorney, Agent, or Firm*—Wenderoth, Lind & Ponack

[57] ABSTRACT

A fuse for use in a high-voltage circuit which has a first fusible element through which most of a current in the fuse flows in a normal state of the fuse and which further breaks into two pieces when overcurrent flows therethrough and further has a second fusible element provided around the first fusible element and adapted to burn in response to the overcurrent for further melting to remaining pieces of the first fusible element in such a manner as to enlarge the distance between the remaining pieces of the first fusible element to an extent sufficient to prevent occurence of a surplus arc therebetween. Further, material of material the first fusible element has a smaller electrical resistance, a larger cross-sectional area and a lower melting point than that of the second fusible element.

6 Claims, 1 Drawing Sheet

PRIOR ART

FUSE FOR USE IN HIGH-VOLTAGE CIRCUIT

BACKGROUND OF THE INVENTION

1. Field of the Invention

The present invention generally relates to a small type fuse for use in a high-voltage circuit (hereinafter sometimes referred to simply as a "high-voltage fuse") and particularly to a "high-voltage fuse" wherein two pieces of a fusible element thereof, which remain therin immediately after the fusible element is severed by the passage of overcurrent through a high-voltage circuit, are separated from each other by a distance sufficient to prevent occurence of a surplus arc therebetween, thereby enhancing the high-voltage circuit's capability of withstanding high-voltage without disruptive discharge.

2. Description of the Prior Art

In a conventional fuse employed in a high-voltage circuit which is contained in a device such as a microwave cooker operating at a high voltage of several kilovolts, after a fusible element thereof is melted by heat generated when overcurrent flows therethrough and is finally broken into two pieces which thereafter operate as electrodes, breakdown of air insulation between the remaining pieces of a fusible element (hereinafter sometimes referred to as "electrodes") can occur and further cause an electric arc therebetween under conditions that the open-gap distance between the "electrodes" is narrow and that a voltage applied therebetween is high. Such phenomenon (that is, the breakdown of air insulation between the "electrodes") cannot be prevented when a fuse employed in a common low-voltage circuit operating at a voltage of below 250 volts is used in such a high voltage circuit. Disadvantageously, surplus flow of the arc current often causes considerable damage to components provided in the device.

Moreover, as is frequency the case with the conventional "high-voltage fuse", when a common fusible element is melted and further severed by the heat generated from the over-current flowing therethrough, the value of a voltage developed across the fuse at the time of severing of the fusible element, that is, the value of a fusing voltage of the conventional "high-voltage fuse" is very low (for instance, about zero). In such a case, the interval between the "electrodes", that is, the distance between two cut ends of the remaining pieces of the fusible element facing each other is so small that a surplus arc may be induced thereafter.

In view of such a problem, there has been provided a conventional "high-voltage fuse" of a type such as shown in FIG. 4 wherein a spring 7 is connected in series with a fusible element 1 by soldering thereto so that the interval between the "electrodes" formed on the heels of the severing of the fusible element 1 is enlarged by contraction of the spring 7. Further, in this figure, reference numerals 4, 5 and 6 indicate a pair of end caps, a fuse tube and a layer of solder used to connect the fuse to the high-voltage circuit (not shown), respectively.

However, in a fuse of such a type in which a fusible element is connected in series with a spring, the fusible element is constantly tensioned by the spring and is thus placed under mechanical stress. Moreover, it is to be noted that ordinarily, differences in magnitude of tension among individual springs used in the fuses of such a type are not negligible. Thus, characteristics of melting and severing of the fusible element (hereafter referred to simply as "fusion") of the conventional "high-voltage fuse" of such a type are not stable.

Furthermore, if an electrical accident occurs and results in a large current flow in the "high-voltage fuse" of such a type, the spring, as well as the solder which is used to connect the fusible element with the spring, can be instantly converted into metal vapor and further an arc can occur in the fuse. The amount of the metal, which serves as a source of the arc, contained in the vapor is so great that the arc can continue for a period of time which is long enough to cause destruction of a fuse tube exposed to the arc.

In addition, the conventional "high-voltage fuse" of such a type has drawbacks that material of an available fusible element and the diameter thereof are restricted to those which enable tensile strength of the fusible element to match with the tension of the spring and that thus, a fuse of small current breaking capacity cannot be produced.

Accordingly, it is an object of the present invention to eliminate the above described defects of the conventional "high-voltage fuse" of such a type and to provide an improved "high-voltage fuse" which can prevent occurence of a surplus arc after "fusion" therein.

SUMMARY OF THE INVENTION

To achieve the foregoing object and in accordance with an aspect of the present invention, there is provided a "high-voltage fuse" which includes a first fusible element adapted to let most of current in the fuse flow therethrough in a normal state thereof and to melt and break into two pieces when overcurrent of more than a value of a minimum fusing current of the fuse flows therethrough and further includes a second fusible element provided around the first fusible element and adapted to burn and further melt the remaining pieces of the first fusible element by the heat accompanied by the rapid burning thereof to enlarge the gap distance between the remaining pieces to an extent sufficient to keep a surplus electric arc from occuring therein, whereby the fuse's capability of withstanding high-voltage without disruptive discharge is enhanced.

BRIEF DESCRIPTION OF THE DRAWINGS

Other objects and advantages of the present invention will be understood by those of ordinary skill in the art after referring to the detailed description of the preferred embodiments of the present invention contained herein and to the accompanying drawings in which like reference numerals refer to like parts and in which.

DESCRIPTION OF THE PREFERRED EMBODIMENTS

Hereinafter, preferred embodiments of the present invention will be elucidated with reference to FIGS. 1 through 3 of the accompanying drawings.

Figure 1:
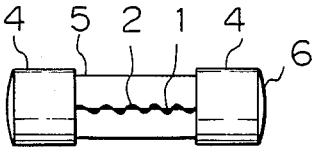
FIG. 1 is a side elevational view of the "high-voltage fuse" embodying the present invention.

First, referring to FIG. 1, there is shown a "high-voltage fuse" embodying the present invention wherein a fusible wire or foil 2 (that is, a second fusible element) is wound around another fusible wire 1 (that is, a first fusible element) through which most of electric current in the fuse flows. Further, as shown in this figure, the fusible part of this fuse consisting of the fusible wire 1 and the additional fusible element 2 is housed in a cylindrical tube 5 having end caps 4 each of which is used as a terminal and connected by solder 6 to the high-voltage circuit. The material of the fusible wire 1 should be selected such as to have a smaller electrical resistance, a larger cross-sectional area and a lower melting point as compared with that of the second fusible element 2. To achieve these conditions and physical properties of the fusible elements 1 and 2, the fusible wire 1 may be made of, for example, silver-copper alloy and the second element 2 may be, for instance, a magnesium wire or a wire made of an alloy containing magnesium.

Furthermore, owing to the above-described physical properties of the fusible wire 1 and the second fusible element 2, most of the current in the fuse flows through the fusible wire 1 and not through the second element 2 under usual conditions. However, when an electrical accident occurs and an overcurrent flows through the fuse, the fusible wire 1 as well as the second fusible element 2 wound thereon are heated and start to melt. The overcurrent further continues to flow through the fuse, with the result that the fusible wire 1, through which most of the overcurrent flows, melts and is severed before the additional fusible element 2 is also severed. Thereafter, the current flows in the additional element 2 which continues to melt under influence of an arc produced at the "fusion" of the fusible wire 1 and before long starts to burn intensely. The burning of the fusible element 2 further continues while the two pieces of the fusible wire 1 formed at the time of severing thereof also melts. Thereby, an interval between the remaining pieces of the fusible wire 1 (that is, "electrodes") is gradually enlarged. According to results of our experiments, the fusible wire 1, as well as the additional fusible element 2, was completely burned and melted up to the terminals of the fuse. In addition, magnesium oxide produced during the burning of the fusible elements 1 and 2 was dispersed into the inner space of the fuse tube 5 and further adhered to the inner surface of the tube 5. This can provide the fuse with high-insulation capability, thereby preventing occurence of glow discharge in the fuse. As a result, differently from the conventional fuse which makes use of a fusible wire and a spring, the fusible elements 1 and 2 completely melt at a relatively low voltage, a value of which is close to zero, so that the interval between the two electrodes is enlarged after the burning of the fuse elements, thereby providing a capability of withstanding high-voltage.

Figure 2:
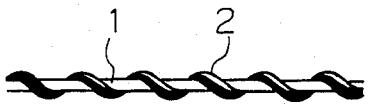
FIG. 2 is an elavation view on an enlarged scale showing a manner of winding a second fusible element for use in enlarging an interval between two "electrodes" around a first fusible element of a "high-voltage fuse" according to the present invention.
Figure 3:
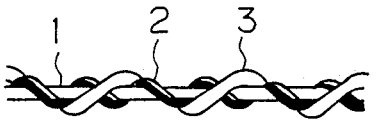
FIG. 3 is an elevation view on an enlarged scale showing a manner of winding second and third fusible elements for use in enlarging the interval between two "electrodes" around a first fusible element of a "high-voltage fuse" according to the present invention.
Figure 4:
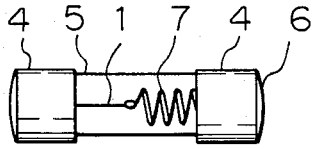
FIG. 4 is a side elevational view of the prior art "high-voltage fuse" in which a fusible element and a spring are connected in series with each other.

It has also been confirmed by out experiments that, by firstly winding the additional fusible element 2 on the fusible element 1 and next winding a third fusible element 3 around the element 1 and 2 as shown in FIG. 2, the fuse of the present invention is given a larger current-conducting capability, while the interval between the "electrodes"after the "fusion" of the element 1 is further enlarged. Further, it is to be noted that the fuse of the present invention provided with fusible foil as a second or third fusible element has the same effects as with a fusible wire. Moreover, the fusible elements thus formed need not be placed under a mechanical tension such as generated by a spring as in the case of the conventional "high-voltage fuse". Furthermore, the amount of the metal in the cylindrical tube of the fuse can be reduced to a minimum. This results in that no noly excellent fusing property and breaking property are exhibited, but also a troublesome operation of soldering up the spring, the fusible element and the terminal, with the spring stretched between the fusible element and the terminal is avoided, whereby efficient production of the fuse is achieved.

As described above, the fuse for use in a high-voltage circuit according to the present invention can be given an excellent voltage withstand property, stable fusing property and breaking property by simply winding one or more additional fusible elements for use in enlarging the distance between two pieces remaining after the "fusion" of the first fusible element thereon.

While the invention has been described in detail and with reference to specific embodiments thereof, it will be apparent to those skilled in the art that various changes and modifications can be made therein without departing from the spirit and scope thereof.

What is claimed is:

1. A fuse for use in a high-voltage circuit comprising, in combination:

a first fusible element which most of an electric current in the fuse flows therethrough in a normal state of the fuse and which is in response to overcurrent of more than a value of a predetermined minimum fusing current of the fuse flowing therethrough when an electrical accident occurs in the high-voltage circuit to melt and break into two pieces;

a second fusible element wound around said first fusible element and adapted to burn in response to the overcurrent for further melting the remaining pieces of said first fusible element after the first fusible element is severed by the passage of the overcurrent to enlarge an open-gap distance between the remaining pieces of said first fusible element to the extent sufficient to prevent occurrence of a surplus arc therebetween; and a fuse tube having two terminals connected to the high-voltage circuit for housing said first and second fusible elements therein, each of the terminals of said fuse tube being connected to corresponding ends of said first and second fusible elements, material of said first fusible element having a smaller electrical resistance, a larger cross-sectional area and a lower melting point as compared with that of said second fusible element, thereby enhancing the fuse's capability of withstanding high-voltage without disruptive discharge.

2. The fuse according to claim 1 wherein at least one additional fusible element for further melting the remaining pieces of said first fusible element to enlarge an open-gap distance between the remaining pieces of said first fusible element is further wound around said first and second fusible elements, the material of said first fusible element having a smaller electrical resistance, a larger cross-sectional area and a lower melting point as compared with that of said additional fusible element, each of the terminals of said fuse tube being connected to corresponding ends of said additional fusible elements, thereby further enlarging the open-gap distance between said pieces of said first fusible element.

3. The fuse according to claim 1 wherein said first fusible element is made from silver-copper alloy and aid second fusible element is made out of a magnesium wire.

4. The fuse according to claim 1 wherein said first fusible element is made from silver-copper alloy and wherein said second fusible element is made from magnesium foil.

5. The fuse according to claim 2 wherein said first fusible element is made from silver-copper alloy and said second and additional fusible elements are made out of magnesium wires.

6. The fuse according to claim 2 wherein said first fusible element is made from silver-copper alloy and wherein said second and additional fusible elements are made from magnesium foil.

* * * * *